US005219086A

United States Patent [19]

Björck

[11] Patent Number: 5,219,086

[45] Date of Patent: Jun. 15, 1993

[54] PACKING CONTAINER FOR LIQUID, ESPECIALLY PRESSURIZED CONTENTS

[75] Inventor: Bengt Björck, Lund, Sweden

[73] Assignee: Tetra Alfa Holdings S.A., Pully, Switzerland

[21] Appl. No.: 703,041

[22] Filed: May 16, 1991

Related U.S. Application Data

[63] Continuation of Ser. No. 482,849, Feb. 22, 1990, abandoned.

[30] Foreign Application Priority Data

Mar. 29, 1989 [SE] Sweden ..... 8901092

[51] Int. Cl.[5] ..... B65D 17/34

[52] U.S. Cl. ..... 220/270; 220/359; 220/612; 220/626; 220/906; 229/4.5; 229/123.1; 229/125.15

[58] Field of Search ..... 220/359, 270, 266, 265, 220/610, 612, 626, 906, 605, 633, 634; 215/232; 229/4.5, 123.1, 125.15

[56] References Cited

U.S. PATENT DOCUMENTS

| | | | |
|---|---|---|---|
| 898,293 | 9/1908 | Warren . | |
| 3,692,202 | 9/1972 | Palagreco | 220/1 BC |
| 3,750,827 | 8/1973 | Wick | 220/458 X |
| 3,883,034 | 5/1975 | Rausing . | |
| 3,977,591 | 8/1976 | Martensson et al. . | |
| 4,012,270 | 3/1977 | Fitko | 156/306 |
| 4,034,132 | 7/1977 | Manuel | 428/36 |
| 4,238,050 | 12/1980 | Le Grow | 220/458 |
| 4,262,819 | 4/1981 | Hayes | 222/92 |
| 4,312,450 | 1/1982 | Reil . | |
| 4,333,585 | 6/1982 | Del Bon | 220/359 |
| 4,367,842 | 1/1983 | Rausing . | |
| 4,397.401 | 8/1983 | Ueno et al. | 220/260 |
| 4,412,644 | 11/1983 | La Fever | 229/1.5 B |
| 4,462,732 | 7/1984 | Bloeck | 413/8 |
| 4,526,287 | 7/1985 | Miyamatsu et al. . | |
| 4,595,114 | 6/1986 | Lu | 220/260 |
| 4,595,116 | 6/1986 | Carlsson . | |
| 4,650,088 | 3/1987 | Hirota et al. . | |
| 4,715,528 | 12/1987 | Kjelgaard et al. . | |
| 4,782,646 | 11/1988 | Nantin . | |
| 4,817,816 | 4/1989 | Leseman et al. | 220/359 |
| 4,858,782 | 8/1989 | Yasumuro et al. | 220/458 |

FOREIGN PATENT DOCUMENTS

| | | |
|---|---|---|
| 563284 | 5/1975 | Switzerland . |
| 643790 | 6/1984 | Switzerland . |
| 650210 | 7/1985 | Switzerland . |
| 2157644 | 10/1985 | United Kingdom . |

*Primary Examiner*—Allan N. Shoap
*Assistant Examiner*—Stephen Cronin
*Attorney, Agent, or Firm*—Burns, Doane, Swecker & Mathis

[57] ABSTRACT

A packing container is disclosed in which an end wall of the packing container has an opening formed therein for emptying the contents of the container. The opening in the end wall is covered by a cover strip which is detachably secured to the end wall. The cover strip and the end wall are formed of a plastic coated metallic material and the cover strip is secured to the end wall along a sealing joint that surrounds the opening. The cover strip is secured to the end wall by surface fusion.

21 Claims, 1 Drawing Sheet

PACKING CONTAINER FOR LIQUID, ESPECIALLY PRESSURIZED CONTENTS

This application is a continuation, of application Ser. No. 07/482,849, filed Feb. 22, 1990 now abandoned.

FIELD OF THE INVENTION

The present invention relates to a packing container. More particularly, the present invention concerns a packing container of the non-returnable type for holding liquid, which comprises at least one plane end wall, an opening incorporated in the end wall for emptying the liquid and an outer cover strip which is applied over the opening to the outside of the end wall.

BACKGROUND OF THE INVENTION

In packing technology, non-returnable packages of the can type are frequently used for the packaging of liquid, especially pressurized, contents such as beer, refreshing beverages and similar carbonated products. These known can packages generally consist of a cylindrical can body provided with a base, the upper end of the can body being closed with the help of a, substantially, planar end wall which is seamed onto the cylindrical can body. The cylindrical can body generally consists of plastic or metal, e.g. iron or aluminum, whereas the planar end wall as a rule always consists of sheet aluminum.

To make the package conveniently openable, the can is provided in most cases with some type of opening arrangement which on the one hand should make the package readily openable and on the other hand should allow a smooth emptying of the contents from the opened package.

A typical opening arrangement on such known can packages has a weakened or openable part in the planar end wall which by means of a pull-ring fixed to the weakened or openable part is adapted so that it can be completely pulled off to expose an emptying opening through which the contents of the package can be made accessible. One problem not infrequently encountered in this intrinsically simple and in most cases well-functioning opening arrangement is that the openable end wall has to be manufactured from a relatively soft material, preferably aluminium, which is both soft and easy to process, but which from a manufacturing point of view is a very energy-consuming and thus cost-demanding metal. In order to make the package more economical, therefore, it is necessary, among other things, to recover and reuse as much as possible of the aluminium content of the package. However the part of the end wall of the package pulled off during opening of the package, including the pull-ring, is thrown away in most cases and thus, is completely lost after a single use. Added to that is the concern that the wasted portion of the end wall represents a substantial environmental problem, since it can remain lying about in nature for a very long time before it breaks down through corrosion, and constitutes during this time, because of its sharp edges, a hazard to humans and animals.

Another opening arrangement on known can packages of the type described above consists of an opening incorporated in the end wall of the drum for emptying the contents which is covered by a cover strip or similar closure device detachably glued onto the outside of the end wall. This known opening arrangement is relatively simple and easy to manufacture and as a rule functions well, but it has the disadvantage, among other things, especially in the case of can packages for pressurized contents, that it requires environmentally doubtful and expensive glue to provide the joint between the cover strip and the package end wall with the required tightness and durability.

OBJECTS AND SUMMARY OF THE INVENTION

The abovementioned inconveniences are overcome in accordance with the present invention where a packing container of the aforementioned type includes a cover strip and an end wall that are made of a material comprising a layer of metal and at least one outer coating of weldable plastics material. The cover strip is connected to the end wall along a sealing joint around the whole emptying opening. The sealing joint is liquid-tight, but is breakable to permit the contents to be emptied. The sealing joint is formed by surface fusion of the plastic coatings facing one another on the cover strip and the end wall respectively.

In accordance with a particularly preferred embodiment of the invention the sealing joint between the cover strip and the end wall of the package is produced by inductive heating in a known manner of the metal layers incorporated in the cover strip and the end wall respectively. That method has been found to permit the package to be closed in a rapid and simple manner while also permitting the actual closing process to be easily monitored both with regard the heating period and the temperature, In that way, the sealing joint will be tighter and more durable than, for example, in the case of glueing.

BRIEF DESCRIPTION OF THE DRAWINGS

The invention will now be described in greater detail with special reference to the attached drawing, wherein.

DETAILED DESCRIPTION OF THE PREFERRED EMBOIDMENT

Figure 1:
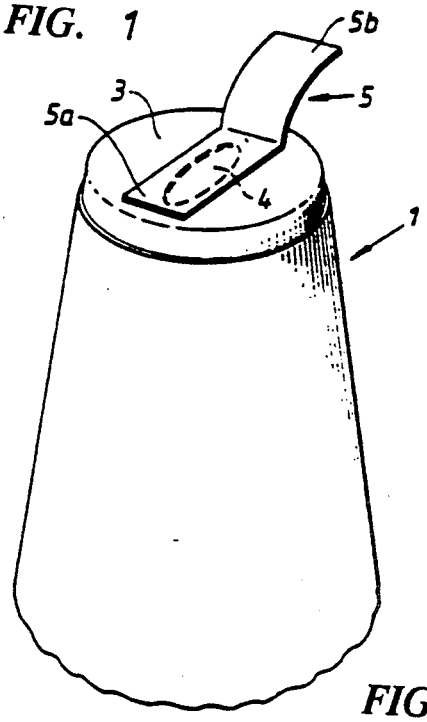
FIG. 1 is a perspective view of the top part of a packing container provided with an opening arrangement in accordance with the invention.

Although the invention can be applied to all packages of the type, it is assumed in the embodiment referred to here that the package, which has been given the general reference designation 1, is of the type which is shown in FIG. 1 and which consists of an upwards tapering can body 2 provided with any kind of bottom closure and a substantially planar end wall 3 arranged at the upper open end of the can body. The end wall 3 has an emptying opening 4 incorporated beforehand which is covered on the top by means of an outer cover strip 5 applied to the outside of the end wall. The cover strip 5 comprises a mounting part 5*a*, which is connected detachably to the end wall 3 over the emptying opening 4, and a readily accessible gripping part 5*b* by means of which the cover strip 5 is adapted to be removed on opening of the package.

Figure 2:
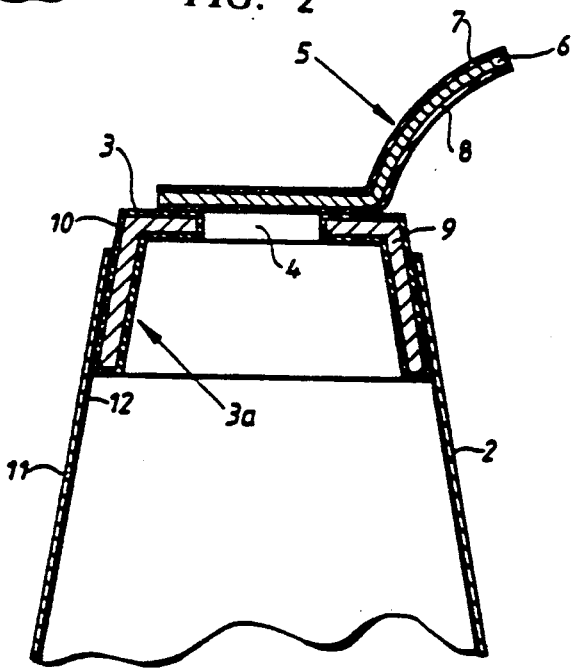
FIG. 2 is across-sectional view of the top part of the container shown in FIG. 1.

As is evident more clearly from FIG. 2, the cover strip 5 is manufactured from a laminated material comprising a central layer of material strong in tension, e.g. iron, and outer coatings 7 and 8 of weldable plastic material, e.g. polyester (preferably polyethylene terephthalate). FIG. 2 further illustrates that the end wall 3 too is manufactured from a material comprising a central metallic layer 9 with an outer coating 10 of weldable plastics material, e.g. polyester (preferably polyethylene terephthalate). The end wall 3 has a downwards directed edge portion 3*a* serving as a fastening means which extends unbroken around the whole periphery of the end wall and which, at least partially, is inserted in, and is fastened to, the inside of the can body 2 along a liquid-tight and mechanically durable sealing joint around the whole thus inserted part of the edge portion 3*a* of the end wall.

As pointed out earlier, it is important that the joint between the outer cover strip 5 and the end wall 3 should be sufficiently strong to be able to withstand the internal pressure of the package, which in the case of contents such as beer, refreshing beverages and similar carbonated drinks may rise to approx. 7 bar. On the other hand, the joint should not be so strong that, upon opening of the package, an intentional pulling off of the cover strip is made impossible or is made unnecessarily difficult. In accordance with the invention a desirable optimum joint is obtained in that the cover strip 5 and the end wall 3 are connected to one another along a sealing joint formed by surface fusion between the plastic coatings 8 and 10 respectively facing one another, and it has been found in particular that a sealing joint which functions well and is easily controllable can be obtained if the cover strip 5 and the end wall 3 are joined to one another by inductive heating of the metal layers 6 and 9 incorporated in the cover strip 5 and the end wall 3 respectively. Such an inductive heat sealing is both rapid and simple and can be carried out with the help of existing conventional equipment. The method, among other things, has the further advantage that it can be easily monitored both with regard to the heating period and to the temperature, so that a mechanically durable sealing joint which is liquid-tight but easily breakable is obtained around the whole emptying opening 4.

The can body 2, which preferably is of the conical shape indicated in FIGS. 1 and 2, is also manufactured appropriately from a material comprising a thin inner metal layer 11 and at least one outer coating 12 of weldable plastic material, preferably polyethylene terephthalate, facing towards the inside of the package, as a result of which the joint between the inserted part of the edge portion 10 of the end wall 3 and the inner plastic coating 12 of the container body 2 can also be achieved by inductive heating in a manner known in itself.

While this invention has been illustrated and described in accordance with a preferred embodiment, it is recognized that variations and changes may be made and equivalents employed herein without departing from the invention as set forth in the claims.

What is claimed is:

1. A container having an interior for holding contents, comprising: a body, an end wall located at one end of the body, an opening formed in the end wall for emptying the contents of the container, and an outer cover strip covering the opening, said end wall being formed of a metal layer and a coating of weldable plastic material, said metal layer of said end wall having an inwardly facing surface which faces towards the interior of the container and an oppositely positioned outwardly facing surface, said opening being defined by a peripheral wall extending between the inwardly and outwardly facing surfaces of the metal layer, said coating of weldable plastic material being disposed on and in contact with at least the outwardly facing surface of the metal layer of the end wall, said coating of weldable plastic material also being disposed on and in contact with substantially the entire peripheral wall that defines the opening in the end wall, said cover strip being formed of a metal layer which has a coating of weldable plastic material disposed on at least one side thereof, said coating of plastic material on the at least one side of the cover strip being in contact with and sealed to the coating of plastic material disposed on the outwardly facing surface of the metal layer of the end wall along a liquid-tight sealing joint that surrounds the opening, said cover strip including a mounting part and a gripping part, said mounting part having an outermost peripheral edge, and wherein the outermost peripheral edge of the mounting part of the cover strip is sealed to the end wall.

2. The container according to claim 1, wherein the metal layer in the end wall is formed at least partially of iron.

3. The container according to claim 1, wherein the metal layer in the cover strip is formed at least partially of iron.

4. The container according to claim 1, wherein the weldable plastic material on the cover strip and the end wall is a polyester material.

5. The container according to claim 4, wherein said polyester material is polyethylene terephthalate.

6. The container according to claim 1, wherein said end wall has an edge portion integrally formed therewith and extending therefrom, said edge portion being secured to the body.

7. The container according to claim 6, wherein said body tapers towards the end wall, said edge portion of the end wall being secured to an inner surface of the tapering body for securing the end wall to the body.

8. The container according to claim 1, wherein said cover strip includes a mounting part and a gripping part formed integrally with and extending from the mounting part, said mounting part being secured to the end wall and covering the opening.

9. The container according to claim 1, wherein said body is formed of a metal layer and a coating of plastic material that faces the interior of the container, said end wall having an edge portion that is surface fused to said coating of plastic material on the body.

10. The container according to claim 9, wherein the coatings of plastic material forming a part of the body, the end wall, and the cover strip are polyester material.

11. The container according to claim 10, wherein the coatings of plastic material forming a part of the body, the end wall, and the cover strip are polyethylene terephthalate.

12. The apparatus according to claim 1, wherein said cover strip includes a mounting part and a gripping part, the thickness of the coatings of plastic material positioned between the metal layer of the end wall and the metal layer of the mounting part after the coatings of plastic material have been sealed to one another is substantially constant over the entire area of the mounting member.

13. The container according to claim 1, wherein said end wall includes an end wall portion and an edge portion extending from the end wall portion, said body including a side wall having an inner surface, said opening for emptying the contents of the container being formed in the end wall portion, said edge portion extending downwardly from said end wall portion and terminating in a free end so that said end wall portion and said edge portion together define a truncated cone-shaped member, and wherein an outer peripheral surface of said edge portion is sealed to the inner surface of the side wall of the body, said free end of the edge portion being coated with plastic material, said end wall portion being positioned above the free end of the edge portion.

14. The container according to claim 1, wherein said body includes a side wall, said outer cover strip being positioned above said side wall of said body.

15. A container for holding pourable contents comprising: a hollow body having a side wall and an open end; an end wall member mounted in said open end, said end wall member having a substantially flat end wall portion and an edge portion integrally formed therewith, said edge portion being sealed in a liquid-tight manner to an inner surface of said side wall adjacent said open end; a pouring opening formed in the end wall portion for pouring the contents out of the hollow body, said pouring opening being defined by a peripheral wall; and a cover strip covering the pouring opening, said cover strip including a mounting part and a gripping part integrally formed with and extending away from the mounting part, said mounting part having an outermost peripheral edge, said mounting part and said end wall member being formed of a central metal layer coated on both sides with a coating of plastic material, the coating of plastic material on one side of the central metal layer of the mounting part facing and being sealed through surface fusion to the coating of plastic material on one side of the central metal layer of the end wall member along a liquid-tight sealing joint that surrounds the pouring opening, the coating of plastic material on the end wall member being disposed on and in contact with substantially the entire peripheral wall that defines the pouring opening in the end wall portion, the thickness of the coatings of plastic material positioned between the metal layer of the end wall member and the metal layer of the mounting part after the coatings of plastic material have been sealed to one another being substantially constant over the entire area of the mounting part.

16. The container according to claim 15, wherein said edge portion extends downwardly from said end wall portion and terminates in a free end so that said end wall portion and said edge portion together define a truncated cone-shaped member, and wherein an outer peripheral surface of said edge portion is sealed to the inner surface of the side wall of the body, said free end of the edge portion being coated with plastic material, said end wall portion being positioned above the free end of the edge portion.

17. The container according to claim 15, wherein said body is formed of a metal layer and a coating of plastic material which faces towards an interior of the container.

18. The container according to claim 17, wherein the coatings of plastic material forming a part of the body, the end wall member, and the cover strip are polyester material.

19. The container according to claim 18, wherein the coatings of plastic material forming a part of the body, the end wall member, and the cover strip are polyethylene terephthalate.

20. The apparatus according to claim 15, wherein outermost portions of the mounting part of the cover strip adjacent the periphery are sealed to the end wall member.

21. The container according to claim 15, wherein said cover strip is positioned above said side wall of said body.

* * * * *